United States Patent [19]

Dickau

[11] Patent Number: 4,955,514

[45] Date of Patent: Sep. 11, 1990

[54] SEALLESS DISPENSING MECHANISM

[75] Inventor: Ewald F. Dickau, Glastenbury, Conn.

[73] Assignee: Loctite Corporation, Newington, Conn.

[21] Appl. No.: 409,278

[22] Filed: Sep. 19, 1989

Related U.S. Application Data

[63] Continuation of Ser. No. 274,666, Nov. 21, 1988, abandoned, which is a continuation of Ser. No. 57,614, Jul. 6, 1987, abandoned.

[51] Int. Cl.[5] ..... B67D 3/00; B67D 5/06

[52] U.S. Cl. ..... 222/518; 222/510

[58] Field of Search ..... 222/518, 510, 504; 251/320, 342

[56] References Cited

U.S. PATENT DOCUMENTS

| | | | |
|---|---|---|---|
| 2,111,168 | 3/1938 | Chansor . | |
| 2,526,735 | 10/1950 | Duce | 222/510 X |
| 2,710,121 | 6/1955 | Rees | 222/510 |
| 2,842,160 | 7/1958 | Rekettye | 222/108 |
| 3,241,727 | 3/1966 | Heckman | 222/518 X |
| 3,258,176 | 6/1966 | Racyznski | 222/475 |
| 3,294,289 | 12/1966 | Bayne et al. | 222/95 |
| 3,318,309 | 5/1967 | Bowen | 222/394 |
| 3,343,719 | 9/1967 | Kastamo et al. | 222/95 |
| 3,463,363 | 8/1969 | Zelna . | |
| 3,731,851 | 5/1973 | Rauh | 222/518 X |
| 3,921,858 | 11/1975 | Bemm | 222/397 |
| 3,943,527 | 3/1976 | Hartmann | 222/108 |
| 4,440,316 | 4/1984 | Christine | 22/518 X |
| 4,452,425 | 6/1984 | Lucking | 222/518 X |

FOREIGN PATENT DOCUMENTS

| | | | |
|---|---|---|---|
| 499310 | 3/1951 | Belgium | 251/320 |
| 633931 | 1/1962 | Canada | 222/510 |

OTHER PUBLICATIONS

"Operating Instructions-725D Diaphragm Valve", 16 pages, copyrighted 1983 by Electron Fusion Devices, inc.

*Primary Examiner*—Joseph J. Rolla
*Assistant Examiner*—Steven Rein
*Attorney, Agent, or Firm*—Edward K. Welch, II; Eugene F. Miller

[57] ABSTRACT

A simplified fluid dispenser for dispensing precise quantities of fluid without requiring special seals, particularly sliding seals, or springs. It comprises a housing defining a fluid reservoir, having an inlet for delivery of pressurized fluid to the reservoir, and including a valve seat defining an outlet for dispensing fluid from the reservoir. A deformable closure member overlies an open end of the housing opposite the outlet and normally biases a valve engageable with the valve seat to the closed position. When the closure member is selectively deformed, the valve is able to move to the open position to dispense a quantity of the fluid from the reservoir. When released, the closure member returns to its normal condition, returning the valve to the closed position instantaneously shutting off the dispensing of fluid. This operation causes the fluid being dispensed to rapidly reverse direction resulting in an immediate termination of flow and elimination of drippage.

19 Claims, 3 Drawing Sheets

SEALLESS DISPENSING MECHANISM

This is a continuation of co-pending application Ser. No. 07/274,666, filed on Nov. 21, 1988, now abandoned, which is a continuation of Ser. No. 07/057,614, filed on July 6, 1987, now abandoned.

BACKGROUND OF THE INVENTION

I. Field of the Invention

The present invention relates generally to fluid dispensing mechanisms and, more particularly, to an improved dispenser of simplified construction which does not require seals, particularly sliding seals, or springs for its operation, yet applies precisely controlled quantities of the fluid to a receiving surface.

II. Description of the Prior Art

There are a number of known designs for dispensing fluids such as adhesives, sealants, and the like, at accurately controlled flow rates, in accurate quantities, and for accurate placement on a receiving surface.

In one instance, a spring biased piston is pneumatically operated to open and close a valve, as needed, to control the flow of fluid to be dispensed from an outlet nozzle. The piston is provided with seals to prevent flow of the fluid in directions other than through the valve and these seals are subject to deterioration and wear, particularly when the fluid being dispensed is heated.

In another known dispenser design, a diaphragm is pneumatically operable to allow or interrupt flow of the fluid to a dispensing nozzle. The diaphragm can be moved by an actuating rod between a bowed position enabling flow to occur between inlet and outlet conduits and a planar position interrupting such flow. Again, proper sealing of the valve is a continuing problem. Specifically, it has not been possible heretofore to adequately seal the unit to prevent flow of the fluid into the actuating mechanism regardless of the type or number of seals being employed by the mechanism.

Another type of dispenser utilizes a positive displacement type of valve in which a quantity of the fluid is admitted into a chamber whereupon a piston then forces that quantity out through the dispensing outlet or nozzle. Again, in this instance, seals are necessary components of the mechanism and are not totally effective in satisfying their intended purpose.

In each of the foregoing instances, loss of the fluid that does not issue from the outlet nozzle but finds its way instead into other cavities of the dispensing mechanism is not the primary concern. Rather, when the fluid is a sealant or adhesive material, it subsequently accumulates, then hardens, and thereby has a detrimental effect on the operation of the dispensing mechanism, even to the point of rendering it inoperative.

Yet another known design of fluid dispenser utilizes a pinch valve according to which an actuator is selectively moved into or out of engagement with flexible tubing which extends from a source of supply to the dispensing head. While seals are not a particular problem with this design of dispenser, the length of the tubing necessary for this design is sufficiently long that it undesirably results in a delayed response time between the operation of the valve and the resultant flow of fluid being dispensed from the nozzle. This, in turn, causes inconsistent flow through the nozzle thereby reducing accuracy, namely, placement of a particular quantity of fluid at a particular location at a particular time.

SUMMARY OF THE INVENTION

It was with knowledge of the prior art, generally as noted above, and the problems existing which gave rise to the present invention. The present invention relates to a simplified fluid dispenser for dispensing precise quantities of fluid without requiring special seals or springs. It comprises a housing defining a fluid reservoir having an inlet for delivery of pressurized fluid to the reservoir, and including a valve seat defining an outlet for dispensing fluid from the reservoir. A deformable closure member overlies an open end of the housing opposite the outlet and normally biases a valve engageable with the valve seat to the closed position. When selectively deformed, the closure member is effective to move the valve to the open position to dispense a quantity of the fluid from the reservoir. When released, the closure member returns to its normal condition, returning the valve to the closed position.

The present invention exhibits a large number of features and benefits not generally found in the prior art. For example, it can dispense fluids having an extremely broad range of viscosities, namely, from one centipoise to a value substantially in excess of one million centipoises.

Furthermore, the dispenser of the invention can be turned on and off instantaneously, that is, starting and stopping a flow of fluid occurs at substantially the same time as operation of the valve actuator. Additionally, fluid does not drip from the outlet nozzle when the valve of the novel dispenser is closed but rather, because of its unique design, the fluid is drawn back thereby avoiding drippage of the fluid.

The dispenser of the invention can utilize low cost materials, such as plastic. Since it utilizes a small number of parts and requires no special seals or springs, and because the parts are interchangeable, both for different materials and for different sizes, it is significantly less costly to manufacture than its prior art counterparts.

Another significant feature of the invention resides in its construction and manner of operation according to which movement of an actuator used to operate the dispenser causes simultaneous and equal movement of the valve off its seat for dispensing the fluid. This feature allows the dispenser to operate at very high actuation speeds. Indeed, the dispensing of the fluid is substantially simultaneous with the actuation of the valve.

The invention utilizes no internal seals, especially sliding seals which are particularly susceptible to wear. Also, it uses a minimum of parts, and flow of the fluid within the dispenser can only occur in the direction of the outlet. As a result, the operation of the invention is not hindered by seals which are particularly susceptible to becoming inoperative by being caked or gummed up with dried or partially dried sealant or adhesive material which are commonly dispensed products.

Other and further features, objects, advantages, and benefits of the invention will become apparent from the following description taken in conjunction with the following drawings. It is to be understood that both the foregoing general description and the following detailed description are explemary and explanatory but are not restrictive of the invention. The accompanying drawings, which are incorporated in and constitute a part of this invention, illustrate some of the embodiments of the invention and, together with the description, serve to explain the principles of the invention in general terms. Like numerals refer to like parts throughout.

DETAILED DESCRIPTION OF THE PREFERRED EMBODIMENTS

Figure 1:
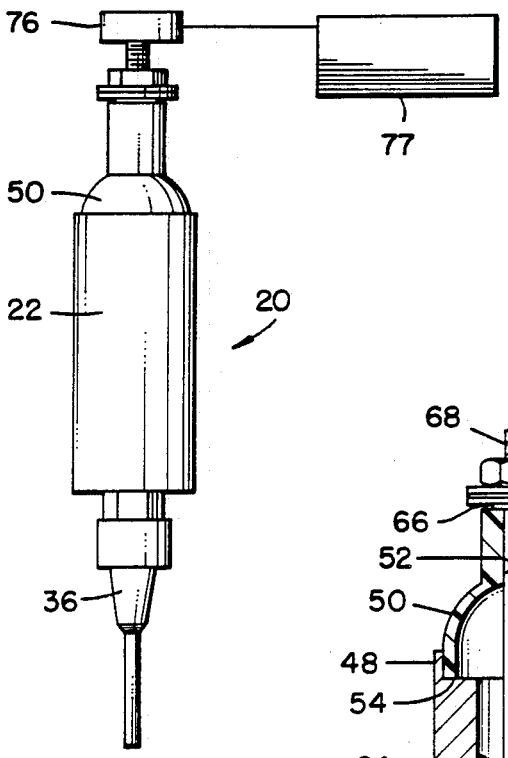
FIG. 1 is a side elevation view of a fluid dispensing mechanism according to the invention and including a diagrammatic representation of an operating and control mechanism associated therewith.

Turn now to the drawings and, initially, to FIG. 1 which depicts a fluid dispenser 20 which embodies the invention. Throughout the disclosure, the term "fluid" will be taken to mean any substance which has the property of flow but excluding gases and total solids while not excluding those substances having solids suspended in a liquid. Indeed, those substances which the dispenser 20 is intended to dispense cover an extremely broad range of viscosities, for example, from water which has a viscosity of one centipoise to tar-like substances which have a viscosity of one million centipoises, or greater.

Figure 2:
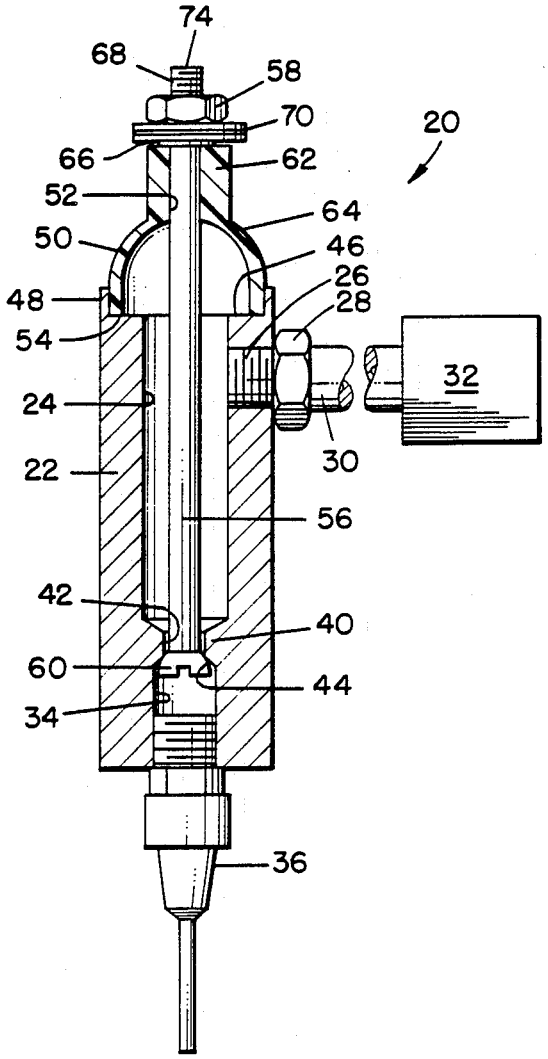
FIG. 2 is a partial cross section view of the dispensing mechanism illustrated in FIG. 1 illustrating the mechanism in its relaxed condition.

Viewing now FIG. 2, the dispenser 20 comprises a housing 22 which may be cylindrical, as illustrated, or of some other suitable shape, so as to define a reservoir 24 therein capable of containing a pressurized fluid. The housing 22 has an inlet 26 which may be tapped to threadedly receive a suitable fitting 28 attached to one end of a supply conduit 30, the other end of which connects to a source 32 of the fluid which includes a suitable pump mechanism for providing the fluid to the reservoir 24 on an as-needed basis. One end of the housing 22 may be provided with a counterbore 34, the outermost end of which may be tapped to threadedly receive a nozzle 36. The nozzle 36 serves to carefully direct the flow of the fluid dispensed from the reservoir 24 in a manner to be described.

At locations intermediate the reservoir 24 and the counterbore 34, the housing 22 is provided with a restricted region 40 in which is formed an outlet 42 defined by a valve seat 44 located immediately downstream thereof. The end of the housing 22 opposite the counterbore 34 may be similarly counterbored to form a continuous annular end surface 46 which thereby defines an annular flange 48 extending longitudinally away from the surface 46.

As seen particularly well in FIG. 2, a closure member in the form of a substantially hemispherical resilient dome 50 overlies the end of the housing 22 defined by the end surface 46. The dome 50 is composed of any suitable deformable material having a memory such that it can be deformed by an outside force, then return t o its original configuration when that force has been withdrawn. DELRIN brand plastic is one example of such a suitable material, particularly for low viscosity fluids, but other plastics, metals, or composite materials with similar memory characteristics can be utilized. The dome 50 has a central opening 52 and terminates at a continuous rim 54 which is engageable with the end surface 46.

Figure 3:
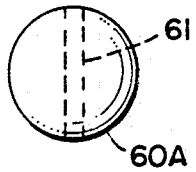
FIG. 3 is a detail view of a component of the fluid dispensing mechanism.

The dome 50 is one component of an actuator mechanism which also includes an elongated stem 56 and a suitable fastener 58. The stem 56 extends through the opening 52 at which it is fittingly attached to the dome 50 and extends through the reservoir 24 and through the outlet 42. At its end farthest from the dome 50, the stem 56 is provided with a gate 60 which is engageable with the valve seat 44 to thereby define a valve for the dispenser 20. The gate 60 may be integrally formed with the stem 56, or it may be a separate item and suitably bonded or fastened to the stem. It will be appreciated that to assure the optimum operation of the dispenser 20, the valve seat 44 must be precisely formed and have a high degree of smoothness to assure complete closure of the outlet 42 when the gate 60 engages the valve seat 44. The valve seat should be composed of an inert material, examples being ceramics, stainless steel, or a hard plastic. As seen in FIG. 3, the gate may be desirably spherical in the manner of a bead 60A formed with a diametral bore 61 therethrough. Such beads 60A may be composed of plastic, glass, ceramic, metal, or any other suitable material capable of being formed to have a high degree of roundness so as to properly and completely engage the valve seat 44.

The dome 50 may be provided with a hollow chimney 62 extending longitudinally outwardly from an outer surface 64 to an extreme end surface 66. An end of the stem 56 opposite the gate 60 projects outwardly from the dome 50 and may be threaded as at 68 to threadedly receive the fastener 58 which may be in the form of a nut.

Figure 4:
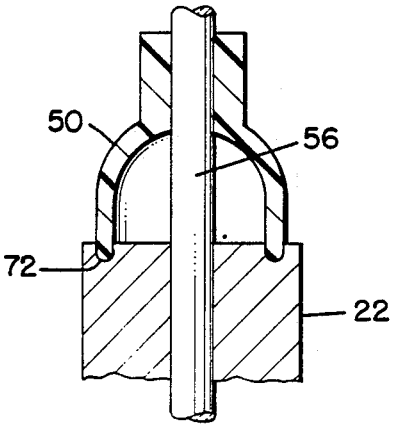
FIG. 4 is a detail cross section view illustrating a portion of a modified fluid dispensing mechanism.

The nut 58 is turned on the stem 56 until it engages the end surface 66. In the alternative, a suitable seal member 70 may be received on the stem 56 intermediate the surface 66 and the nut 58 to further prevent escape of any fluid from the reservoir 24. In either event, the nut 58 is tightened down to a sufficient extent that the gate 60 is caused to firmly engage the valve seat 44 and such that, simultaneously, the rim 54 engages the end surface 46. At the same time, the nut 58 should not be tightened to such an extent as to cause any deformation of the dome 50. When this relationship has been achieved such that any movement of the dome is immediately imparted to the gate 60, without lost motion, it may be desirable to suitably bond the stem 56 to the dome 50 and the nut 58 and the seal 70 together and both, in turn, to the dome 50. With the nut 58 tightened down as indicated in FIG. 2, it will be noted that the outer diameter of the dome 50 adjacent its rim 54 is substantially the same as the inner diameter of the annular flange 48. Although the annular flange 48 may not be necessary for the purposes of the invention, it does serve as an aid to prevent the lateral expansion of the dome adjacent its rim 54 during the operation of the invention as will be described. In another embodiment of the invention as seen in FIG. 4, it may be desirable to replace the annular flange 48 with an annular groove 72 to engageably receive the rim 54 of the dome 50.

Figure 5:
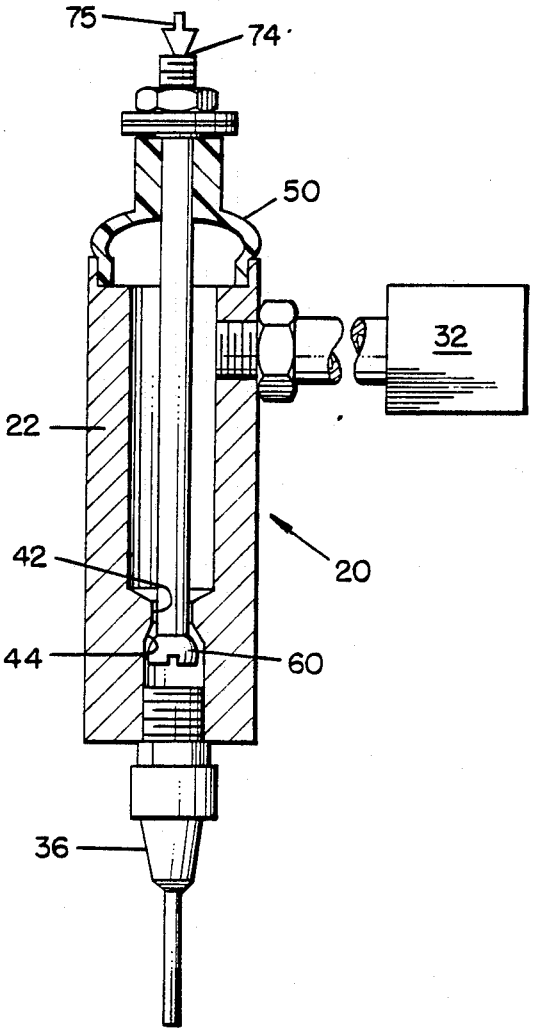
FIG. 5 is a cross section view, similar to FIG. 2, illustrating the fluid dispensing mechanism in its operative condition.

In the operation of the invention, an operator can grasp the housing 22 in his hand, for example, like holding a pencil, while an extreme end 74 of the stem 56 is manually or automatically activated. Thus, when the stem 56 is depressed in the direction of an arrow 75 as indicated in FIG. 5, the dome 50 is deformed and this deformation allows the gate 60 to leave its engagement with the valve seat 44. The pressure within the reservoir 24 caused by the source 32 is effective to cause the fluid therein to pass through the outlet 42 and eventually through the nozzle 36 and onto an appropriate receiving surface. When the force of the actuating mechanism is released from the extreme end 74, the dome 50 returns to its original position and draws with it the gate 60 which again engages the valve seat 44. The magnitude of the gate 60 and its closing velocity cause the fluid being dispensed to rapidly reverse direction resulting in an immediate termination of flow and elimination of drippage of the type often associated with known devices. The viscosity of the fluid is also an important factor in combination with the magnitude and velocity of the gate in achieving this desired goal. Specifically, the greater the magnitude of the gate, the greater its velocity and the higher the viscosity of the fluid, the greater is the effect of terminating flow and eliminating drippage. In this manner, there is no dripping associated with the dispenser 20 as flow is caused to terminate. This is true regardless of the viscosity of the fluid and it was previously explained that the dispenser 20 is useful for dispensing fluids having an extremely wide range of viscosities, namely, within the range of one to one million plus centipoises.

The dispenser 20 is capable of dispensing part or all of the fluid contained in the reservoir 24. It will be appreciated that the pump mechanism at the source 32 constantly keeps the reservoir 24 pressurized, even when flow of additional fluid may have been terminated Thus, if desired, all of the contents of the dispenser 20 may be fully dispensed, leaving substantially no undesired residue of the fluid in the reservoir 24. It is also possible to evacuate all fluid from the dispenser 20 back to the source 32, should that be desired.

As indicated in FIG. 1, not only is the dispenser 20 manually usable, but the stem 56 can be driven by a variety of different mechanisms which can even be computer controlled. Thus, a drive mechanism 76 may be, for example, an electrically operated solenoid, or a mechanical cam, or a hydraulically or pneumatically operated device. Operation of the drive mechanism may be under the control of an appropriate computer 77 and, using any of these types of drive mechanisms, the dispenser 20 can be readily adapted for robotics usage. The computer 77 may also control the source 32 for regulating the amount and pressure of the fluid provided to the reservoir 24. It is especially attractive in this type of a use because its simplicity of construction and operation assures that it can operate for exceptionally long periods of time between failures, primarily as a result of the lack of moving parts such as sliding seals.

Figure 6:
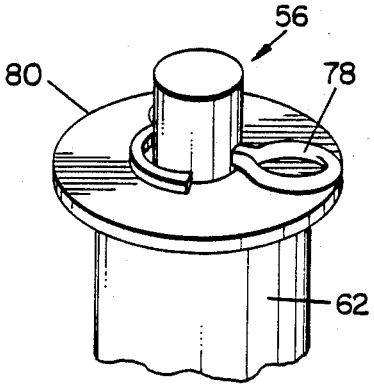
FIGS. 6 and 7 are detail perspective views illustrating other embodiments of the invention.
Figure 7:
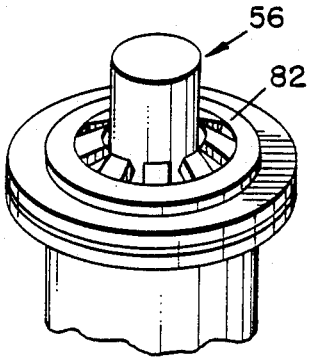

While components of the dispenser 20 other than the dome 50 could be made of durable, long lasting, but expensive, materials such as stainless steel, it may desirable and practical to use less expensive plastic or composite materials in its construction. Such plastic or composite materials could be easily and inexpensively molded. Additionally, in another embodiment of the invention, the nut 58 may be replaced by some other type of fastener. In one instance, for example, as seen in FIG. 6, a cotter pin 78 may be utilized in a known fashion in combination with a backing washer 80 so positioned on the stem 56 to assure that the gate 60 is engaged with the valve seat 44 when the dome 50 is in its relaxed condition. Alternatively, as seen in FIG. 7, a speed nut 82 may be received on the end of the stem 56 to maintain that relative positioning of the gate 60 and valve seat 44. Both of the latter two constructions are desirable because there is no need to tap the end of the stem 56, with a resulting savings in cost. Indeed, it would be possible for the dispenser to be constructed in some other fashion such that an end of the stem 56 opposite the gate 60 is permanently fixed to the dome 50 in a manner not requiring a fastener.

Figure 8:
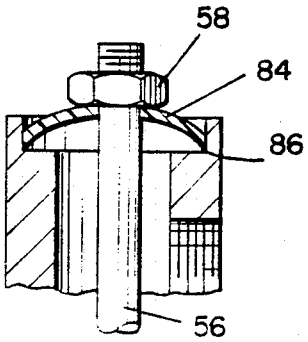
FIGS. 8 and 9 are detail cross section views illustrating still other embodiments of the invention.

As seen in FIG. 8, a modified closure member, specifically cap member 84, is illustrated in place of the dome 50, and is seen to be of concave cross section. While the cap member 84 is not hemispherical as the dome 50 and is therefore much shallower, that is, occupies much less distance in a direction along the stem 56 between the nut 58 and its peripheral rim 86, it has all of the other characteristics of deformability and plastic memory that the dome 50 has.

Figure 9:
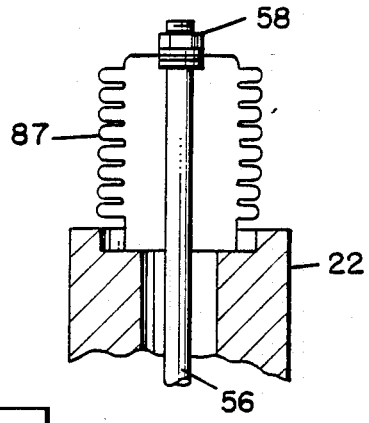

Yet another embodiment is illustrated in FIG. 9. In this instance, another modified closure member in the form of a bellows 94 replaces the dome 50. Again, the bellows possesses the characteristics of deformability and plastic memory which are necessary for the successful operation of the dispenser of the invention. It is particularly desirable for use in those situations in which a highly viscous fluid is being dispensed by reason of its ability to operate through a relatively greater range of movement. This enables the gate 60 to be moved a greater distance away from the valve seat 44 to more readily permit flow of fluid to the nozzle 36.

Figure 10:
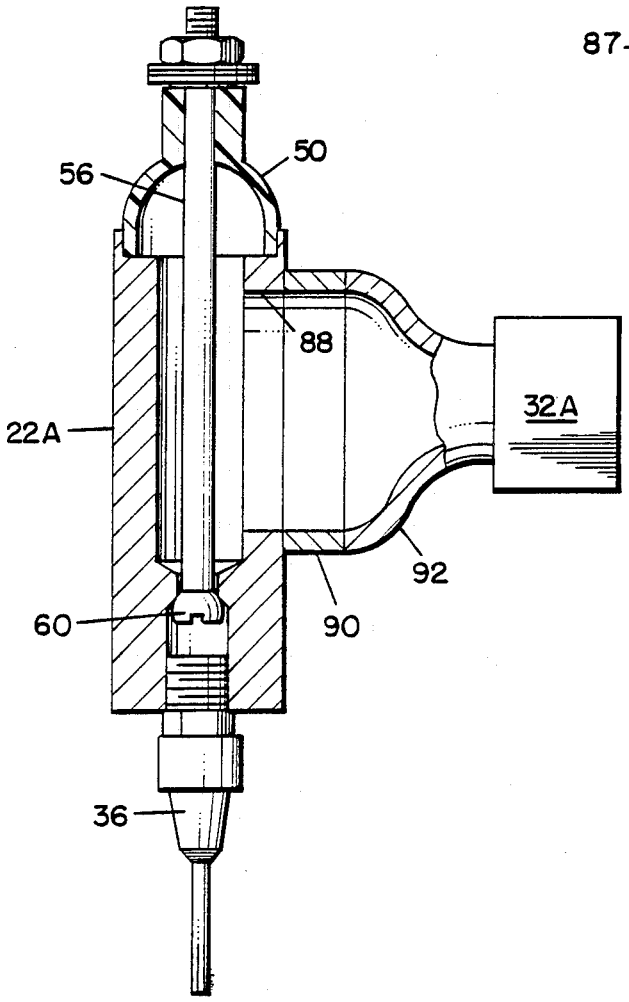
FIG. 10 is a side elevation view, partially cut away and in section, illustrating still another embodiment of the invention.

Yet another embodiment of the invention is illustrated in FIG. 10. In this instance, a modified housing 22A has an elongated inlet 88 disposed generally parallel to an axis of the stem 56. A reservoir/adapter 90 integral with the housing 22A overlies the inlet 88 and is connected as by a conduit 92 to a source 32A for the fluid. This design may be utilized to receive highly viscous fluids which cannot easily be conducted through smaller conduits and apertures. In all other respects, however, a dispenser so modified would operate similarly to the dispenser 20. As noted above, it may be preferable to use the bellows 87 in this situation in place of the dome 50.

It will also be appreciated that by using modern plastic molding techniques, the housing 22 and dome 50, or equivalent closure construction, may be an integral structure. For this purpose, provision should be made for the wall thickness in the structure opposite the gate 60 to be somewhat reduced from the remainder of the structure so as to enable the flexing or deformation of the nature permitted by the dome 50, cap member 84, or bellows 87. In this construction of the dispenser, the end of the stem opposite the gate would be fixed to the deformable portion in some suitable fashion, which may be in a manner as disclosed herein, or otherwise.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Apparatus for dispensing precise quantities of a broad range of fluid products, including adhesives and sealants, regardless of orientation, comprising:

(1) a wand-like dispenser portion, capable of dispensing the fluid product in a drop-wise or stream-like fashion, comprising a generally cylindrical housing defining a fluid reservoir and having a continuously open inlet for delivery of pressurized fluid product to the reservoir for continuously maintaining a filled reservoir and for maintaining pressure in said reservoir even when flow of fluid out of said reservoir may have been terminated and including a valve seat defining an outlet for dispensing the fluid product from the reservoir, said housing being open at an end opposite said valve seat and terminating thereat at a continuous annular end surface; and a deformable resilient fluid tight closure member overlying the open end of said housing, said closure member having a central opening and an outer peripheral surface terminating in a continuous rim, said rim being sealingly engageable with said end surface; and an elongated stem member extending through the outlet and including a gate member at one end, said gate member having a rounded surface for sealing engagement with said valve seat, said stem member being fittingly received in and extending through said central opening of said closure member and being fixedly and sealingly attached thereto distant from said gate member; and said stem member and said closure member being responsive to an external force acting upon said stem member in the direction of the valve seat to thereby cause sufficient movement of said stem member in said direction, along the axis thereof, and deformation of said closure member to concurrently cause said gate member to move from a first position in sealing engagement with said valve seat to a second position disengaged from said valve seat thereby allowing the fluid product to be dispensed from said reservoir through said outlet; and said stem member and said closure member being responsive to the removal of said external force such that the stem member returns to its original position and the closure member is restored to its original shape and, concurrently, said gate member moves from said second position to said first position thereby terminating the dispensing of the fluid product; and nozzle means attached to said housing such that said nozzle means and said valve seat define a dispensing chamber in which said valve gate reciprocates between said first and second positions and wherein when said valve gate moves from said second position to said first position said movement, and the concurrent movement of the stem member and the reformation of the closure member, cause the fluid being dispensed from the nozzle to rapidly reverse direction thereby causing the fluid to be drawn back into the nozzle so as to eliminate drippage;

(2) a pressurized source of the fluid product; and (3) conduit means for supplying to said reservoir fluid product under pressure, said conduit means connected at one end to said pressurized source and at its other end to the inlet opening in said housing;

wherein, in operation, said pressurized source and said conduit means operate to keep said reservoir filled with fluid product under pressure.

2. Apparatus as set forth in claim 1 wherein the inlet is elongated generally along the length of said housing; and including:

reservoir/adapter means mounted on said housing so as to overlie the inlet;

a pressurized source of the fluid distant from said housing; and conduit means connecting said source to said reservoir/adapter means.

3. Apparatus as set forth in claim 1 including:

drive means for selectively applying the external force to said stem member.

4. Apparatus as set forth in claim 1 wherein said closure member is a substantially hemispherical dome integral with said housing and having a generally concave surface facing said valve seat.

5. Apparatus as set forth in claim 1 wherein said closure member is a bellows integral with said housing and facing said valve seat.

6. Apparatus as set forth in claim 1 including fastener means for attaching said stem member to said closure member.

7. Apparatus as set forth in claim 1 including adjustable fastener means for attaching said stem member to said closure member so as to eliminate lost motion between said stem member and said closure member.

8. Apparatus as set forth in claim 1 wherein said housing has a counterbore at said open end to thereby define an annular flange extending away from said end surface, the inner diameter of said flange being generally equal to the outer diameter of said rim thereby restraining said closure member against lateral movement relative to said housing.

9. The apparatus of claim 1 wherein the closure member is a concave cap member wherein the concave surface faces the valve seat.

10. The apparatus of claim 1 wherein the dispensing chamber is further defined by a second counterbore in said housing intermediate said valve seat and said nozzle.

11. The dispenser of claim 1 wherein the closure member is a concave cap member wherein the concave surface faces the valve seat.

12. The dispenser of claim 1 wherein the dispensing chamber is further defined by a second counterbore in said housing intermediate said valve seat and said nozzle.

13. A dispenser for dispensing precise quantities of a broad range of fluid products, including adhesives and sealants, regardless of orientation, comprising:

a generally cylindrical housing defining a fluid reservoir and having a continuously open inlet for delivery of pressurized fluid product to the reservoir for continuously maintaining a filled reservoir and for maintaining pressure in said reservoir even when flow of fluid out of said reservoir may have been terminated and including a valve seat defining an outlet for dispensing the fluid product from the reservoir, said housing being open at an end opposite said valve seat and terminating thereat at a continuous annular end surface; and a deformable resilient fluid tight closure member overlying the open end of said housing, said closure member having a central opening and an outer peripheral surface terminating in a continuous rim, said rim being sealingly engageable with said end surface; and an elongated stem member extending through the outlet and including a gate member at one end, said gate member having a rounded surface for sealing engagement with said valve seat, said stem member being fittingly received in and extending through said central opening of said closure member and being fixedly and sealingly attached thereto distant from said gate member; and said stem member and said closure member being responsive to an external force acting upon said stem member in the direction of the valve seat to thereby cause sufficient movement of said stem member in said direction, along the axis thereof, and deformation of said closure member to concurrently cause said gate member to move from a first position in sealing engagement with said valve seat to a second position disengaged from said valve seat thereby allowing the fluid product to be dispensed from said reservoir through said outlet; and said stem member and said closure member being responsive to the removal of said external force such that the stem member returns to its original position and the closure member is restored to its original shape and, concurrently, said gate member moves from said second position to said first position thereby terminating the dispensing of the fluid product; and nozzle means attached to said housing such that said nozzle means and said valve seat define a dispensing chamber in which said valve gate reciprocates between said first and second positions and wherein when said valve gate moves from said second position to said first position said movement, and the concurrent movement of the stem member and the reformation of the closure member, cause the fluid being dispensed from the nozzle to rapidly reverse direction thereby causing the fluid to be drawn back into the nozzle so as to eliminate drippage;

wherein said dispenser is of a wand-like configuration and wherein, in operation, said dispenser is to be connected to an isolated, pressurized source of fluid product, removed from said apparatus, through a supply conduit connected at one end to said open inlet of said housing and at its other end to said pressurized source, to supply said reservoir with fluid product and maintaining the same under pressure and in a filled state, and said nozzle means is capable of dispensing said fluid product as individual drops or in a continuous stream.

14. The dispenser of claim 13 wherein the inlet is elongated generally along the length of said housing and including:

reservoir/adapter means mounted on said housing so as to overlie the inlet;

a pressurized source of the fluid distant from said housing; and conduit means connecting said source to said reservoir/adapter means.

15. The dispenser of claim 13 including drive means for selectively applying the external force to said stem member.

16. The dispenser of claim 13 wherein said closure member is a substantially hemispherical dome integral with said housing and having a generally concave surface facing said valve seat.

17. The dispenser of claim 13 including fastener means for attaching said stem member to said closure member.

18. The dispenser of claim 13 including adjustable fastener means for attaching said stem member to said closure member so as to eliminate lost motion between said stem member and said closure member.

19. The dispenser of claim 13 wherein said housing has a counterbore at said open end to thereby define an annular flange extending away from said end surface, the inner diameter of said flange being generally equal to the outer diameter of said rim thereby restraining said closure member against lateral movement relative to said housing.

* * * * *